US012485319B2

(12) United States Patent
Takehara et al.

(10) Patent No.: US 12,485,319 B2
(45) Date of Patent: Dec. 2, 2025

(54) GOLF CLUB HEAD HAVING IMPROVED STRIKING FACE

(71) Applicant: Acushnet Company, Fairhaven, MA (US)

(72) Inventors: Doug M. Takehara, Oceanside, CA (US); Jonathan Hebreo, San Diego, CA (US); Richard L. Cleghorn, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 69 days.

(21) Appl. No.: 18/336,670

(22) Filed: Jun. 16, 2023

(65) Prior Publication Data

US 2024/0416188 A1 Dec. 19, 2024

(51) Int. Cl.
*A63B 53/04* (2015.01)

(52) U.S. Cl.
CPC ..... *A63B 53/0458* (2020.08); *A63B 53/0408* (2020.08); *A63B 53/047* (2013.01)

(58) Field of Classification Search
CPC .. A63B 53/04; A63B 53/0458; A63B 53/0462
USPC ..... 473/342
See application file for complete search history.

(56) References Cited

U.S. PATENT DOCUMENTS 3,751,035 A * 8/1973 Lockwood ..... A63B 53/04 473/290
4,749,197 A * 6/1988 Orlowski ..... A63B 60/00 473/342
5,028,049 A * 7/1991 McKeighen ..... A63B 53/0466 473/345
5,669,824 A * 9/1997 Aizawa ..... A63B 60/00 473/291
5,707,302 A * 1/1998 Leon ..... A63B 60/54 473/332
6,162,133 A * 12/2000 Peterson ..... A63B 53/0466 473/345
6,379,262 B1 * 4/2002 Boone ..... A63B 53/04 473/324
6,508,722 B1 * 1/2003 McCabe ..... A63B 53/04 473/345
6,605,007 B1 8/2003 Bissonnette et al.
6,800,039 B1 * 10/2004 Tseng ..... A63B 53/0466 473/345
6,904,663 B2 6/2005 Willett et al.
7,169,062 B2 * 1/2007 Chen ..... A63B 53/0466 473/329
7,235,023 B2 * 6/2007 Sugimoto ..... A63B 53/047 473/291
7,278,925 B2 * 10/2007 Oyama ..... A63B 53/0466 473/345
7,390,270 B2 * 6/2008 Roberts ..... A63B 60/54 473/332

(Continued)

FOREIGN PATENT DOCUMENTS

JP 06233840 A * 8/1994
JP 08243195 A * 9/1996 ..... A63B 53/04

(Continued)

*Primary Examiner* — Alvin A Hunter

(57) ABSTRACT

A golf club head having an improved striking face is disclosed herein. More specifically, the golf club head in accordance with the present invention has a striking face including a thin center zone and multiple zones surrounding the center zone.

19 Claims, 3 Drawing Sheets

(56) References Cited

U.S. PATENT DOCUMENTS

| | | | | |
|---|---|---|---|---|
| 7,578,755 | B2 * | 8/2009 | Oyama | A63B 53/0466 473/345 |
| 8,535,177 | B1 * | 9/2013 | Wahl | A63B 53/04 D21/748 |
| 9,561,412 | B2 * | 2/2017 | Ueda | A63B 53/047 |
| 11,771,962 | B2 * | 10/2023 | Griffin | A63B 53/0425 473/342 |
| 2005/0009631 | A1 * | 1/2005 | Krumme | A63B 53/047 473/342 |
| 2008/0096689 | A1 * | 4/2008 | Oyama | A63B 53/0466 473/349 |
| 2011/0105243 | A1 * | 5/2011 | Brunski | A63B 60/00 473/342 |
| 2022/0054902 | A1 * | 2/2022 | Griffin | A63B 53/0416 |
| 2024/0278089 | A1 * | 8/2024 | Takehara | A63B 53/0408 |

FOREIGN PATENT DOCUMENTS

| | | | | | |
|---|---|---|---|---|---|
| JP | 09192270 | A | * | 7/1997 | A63B 53/0466 |
| JP | 09239074 | A | * | 9/1997 | A63B 53/0466 |
| JP | 2000126340 | A | * | 5/2000 | A63B 53/0466 |
| JP | 2004187710 | A | * | 7/2004 | A63B 53/047 |
| JP | 2008099903 | A | * | 5/2008 | A63B 53/0466 |
| JP | 2011098200 | A | * | 5/2011 | A63B 53/04 |
| JP | 2015036052 | A | * | 2/2015 | A63B 53/0408 |

* cited by examiner

GOLF CLUB HEAD HAVING IMPROVED STRIKING FACE

FIELD OF THE INVENTION

The present invention relates generally to a golf club head having an improved striking face. More specifically, the golf club head in accordance with the present invention is comprised of a striking face portion having a plurality of regions. Each of the regions has a different thickness profile for improved COR.

BACKGROUND OF THE INVENTION

Modern day golf club design has evolved since the early days of golf. The good news of all the technological advancements in golf club technology is that it makes the game of golf easier for golfers of all skill levels. However, all these advancements come with tremendous challenges for the golf club engineer.

A very important area in golf club design is the striking surface. The striking face is the portion of the golf club head that interacts with the golf ball at impact and influences the balls trajectory, speed and spin. All of these parameters are important to the golfer as they influence the ball's travel distance and flight shape. Thus, designing a striking face that provides improved performance is highly desired.

U.S. Pat. No. 6,605,007 to Bissonnette et al. defines a golf club having a variable face thickness. The face is comprised of a center zone being between 15% and 60% of the striking face's total area. The center zone is surrounded by a perimeter zone and the center zone has a substantially greater flexural stiffness than the perimeter zone.

Similarly, U.S. Pat. No. 6,904,663 to Willett et al. defines a golf club with substantial thickness variation. The thickness variation is achieved by machining a striking face such that there is a small central recess having a thickness similar to the upper recess and heel and toe thicknesses that are minimum thicknesses. The thickest portion of the face surrounds the small central recess.

BRIEF SUMMARY OF THE INVENTION

One aspect of the present invention is a golf club comprising a golf club head, a grip and a shaft therebetween, wherein the golf club head has improved COR and feel. The golf club head is preferably comprised of a striking face portion located at a frontal portion and a body portion attached to the striking face portion to form a cavity therebetween. The striking face is comprised of a thin center zone and multiple, variable-thickness zones surrounding the center zone.

Another embodiment of the present invention comprises an iron type golf club with a club head, a grip and a shaft therebetween. The golf club head is comprised of a striking face portion located at a frontal portion of the club head and a body portion comprising a hosel for receiving the shaft, and a club head perimeter comprised of a topline extending across an upper portion of the club head, a toe portion, a heel portion and a sole portion at a bottom portion of the club head. The striking face portion has a striking face area and comprises a center zone that surrounds a face center of the striking face portion. The center zone has a substantially uniform thickness and has a center zone area that is between about 15% and 30% of the striking face area. A plurality of surrounding zones extend between the center zone and club head perimeter and have a minimum thickness adjacent the center zone and continuously increase in thickness to maximum thicknesses adjacent the club head perimeter. Preferably, the thickness of the surrounding zones increase linearly at a slope of between about 1° and 5°. Preferably, the center zone thickness is less than 2 mm and the striking face portion has a mass of greater than 54 grams.

One aspect of the present invention is an iron type golf club comprising a golf club head, a grip and a shaft therebetween, wherein the golf club head has improved COR and feel. The golf club head is preferably comprised of a striking face portion located at a frontal portion and a body portion attached to the striking face portion to form a cavity therebetween. The golf club head has a topline, a sole, a toe portion, a heel portion and a hosel. In the invention, the striking face portion preferably has nine zones, including a center zone, an upper center zone, a lower center zone, a heel upper zone, a heel center zone, a heel lower zone, a toe upper zone, a toe center zone and a toe lower zone. The center zone includes the face center and preferably has a minimum thickness of the striking face.

Another preferred embodiment of the present invention is an iron type golf club comprising a golf club head, a grip and a shaft therebetween, wherein the golf club head comprises an improved striking face having a center zone, an upper center zone, a lower center zone, a heel upper zone, a heel center zone, a heel lower zone, a toe upper zone, a toe center zone and a toe lower zone. The center zone includes the face center, has a minimum face thickness and comprises between about 10% and 40% of the total striking face area. Moreover, the center zone is preferably a constant thickness and forms a quadrilateral shape. Even more preferably, the center zone is a parallelogram and, most preferably, a rectangle.

Another preferred embodiment of the present invention is an iron type golf club comprising a club head, a grip and a shaft therebetween. The golf club head is comprised of a striking face portion located at a frontal portion of the club head and a body portion comprising a hosel for receiving the shaft, a topline extending across an upper portion of the club head, a toe portion, a heel portion and a sole portion at a bottom portion of the club head. The improved striking face portion has a striking face area and comprises nine zones, including a center zone that surrounds a face center of the striking face portion, an upper center zone located between the center zone and the topline, a lower center zone located between the center zone and the sole, a heel center zone located between the center zone and the heel portion, a heel upper zone located between the heel center zone and the topline, a heel lower zone located between the heel center zone and the sole, a toe center zone located between the center zone and the toe portion, a toe upper zone located between the toe center zone and the topline, and a toe lower zone located between the toe center zone and the sole. The center zone has a substantially uniform thickness t1 and has a center zone area A1 that is between about 15% and 35% of the striking face area. Preferably, the center zone area is the largest of all nine zones. The upper center zone preferably has a variable thickness that increases from a minimum thickness t1 adjacent to the center zone to a maximum thickness t2 adjacent the topline. The lower center zone preferably has a variable thickness that increases from minimum thickness t1 adjacent to the center zone to a maximum thickness t3 adjacent the sole. The heel center zone preferably has a variable thickness that increases from minimum thickness t1 adjacent to the center zone to a maximum thickness t4 adjacent the heel portion. The lower heel zone preferably has a variable thickness that increases from minimum thickness t1 at a point adjacent to the center zone and heel center zone to a maximum thickness t6 adjacent the sole. The toe center zone preferably has a variable thickness that increases from minimum thickness t1 adjacent to the center zone to a maximum thickness t7 adjacent the toe portion. The upper toe zone preferably has a variable thickness that increases from minimum thickness t1 at a point adjacent to the center zone and toe center zone to a maximum thickness t8 approximate the topline and the lower toe zone has a variable thickness that increases from minimum thickness t1 at a point adjacent to the center zone and toe center zone to a maximum thickness t9 adjacent the sole. Preferably, the toe upper zone maximum thickness t8 is the greatest thickness on the striking face.

In a preferred embodiment, the center thickness t1 is less than 2.2 mm, and more preferably, the center thickness t1 is between about 1.5 mm and 2.0 mm and the center zone has a substantially quadrilateral perimeter. More preferably, the center zone has a substantially rectangular perimeter. Preferably, the striking face minimum thickness t1 is less than 60% of the striking face maximum thickness t8. Further, it is preferred that the striking face minimum thickness t1 is less than 80% of the striking face thickness at the heel portion t4. Further still, the striking face thickness at the top line t2 is preferably at least 25% greater than the striking face minimum thickness t1.

In a preferred embodiment of the present inventions the center zone has a substantially constant thickness and all of the other zones have variable thicknesses that constantly increase from the center zone. For example, the thickness across the lower center zone continuously increases from t1 to t3 and t3 is at least 10% greater than t1, the thickness across the heel center zone continuously increases from t1 to t4. Similarly, the thickness across the heel upper zone continuously increases from t1 to t5 and the thickness across the heel lower zone continuously increases from t1 to t6. The thickness across the toe center zone also continuously increases from minimum thickness t1 to the maximum thickness t7. The thickness across the toe upper zone continuously increases from t1 to t8, while the thickness across the toe lower zone continuously increases from t1 to t9.

In an embodiment of the present invention, the center zone has a center zone area A1 that is between about 15% and 35% of the striking face area. Preferably, the center zone has a center zone area A1 that is greater than the toe upper zone area A8 and the toe upper area A8 is between about 10% to 30% of the striking face area. Moreover, the center zone has a center zone area A1 that is greater than the toe center zone area A7 and the toe center area A7 is between about 10% to 30% of the striking face area.

Another preferred embodiment of the present invention is an iron type golf club comprising a club head, a grip and a shaft therebetween. The golf club head is comprised of a striking face portion located at a frontal portion of the club head and a body portion comprising a hosel for receiving the shaft, a topline extending across an upper portion of the club head, a toe portion, a heel portion and a sole portion at a bottom portion of the club head. The striking face portion has a striking face area and comprises nine zones, including a center zone that surrounds a face center of the striking face portion, an upper center zone located between the center zone and the topline, a lower center zone located between the center zone and the sole, a heel center zone located between the center zone and the heel portion, a heel upper zone located between the heel center zone and the topline, a heel lower zone located between the heel center zone and the sole, a toe center zone located between the center zone and the toe portion, a toe upper zone located between the toe center zone and the topline, and a toe lower zone located between the toe center zone and the sole. The center zone has a substantially uniform thickness t1 and has a center zone area A1 that is between about 15% and 35% of the striking face area. The upper center zone has a variable thickness that increases from a minimum thickness t1 adjacent to the center zone to a maximum thickness t2 adjacent the topline and has an upper center zone area A2 that is between 5% and 15% of the striking face area. The upper center zone maximum thickness t2 is preferably at least 25% greater than the center zone thickness t1. The lower center zone has a variable thickness that increases from a minimum thickness t1 adjacent to the center zone to a maximum thickness t3 adjacent the sole. The heel center zone has a variable thickness that increases from the minimum thickness t1 adjacent to the center zone to a maximum thickness t4 adjacent the heel portion, and the toe center zone has a variable thickness that increases from the minimum thickness t1 adjacent to the center zone to a maximum thickness t7 adjacent the toe portion and has a toe center zone area that is between 10% and 30% of the striking face area, the center zone minimum thickness t1 is less than 65% of the toe center zone maximum thickness t7.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention.

The description is not to be taken as limiting the invention and is provided for the sole purpose of illustrating the general principles of the invention. The scope of the invention is best defined by the appended claims. Various inventive features are described below, and each can be used independently of one another or in combination with other features.

Figure 1:
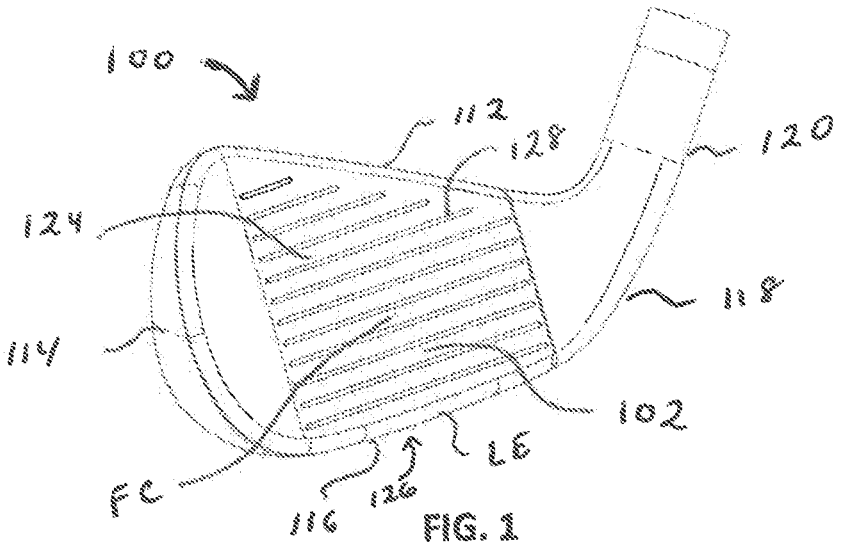
FIG. 1 of the accompanying drawings shows a frontal, perspective view of a golf club head in accordance with an embodiment of the present invention.
Figure 2:
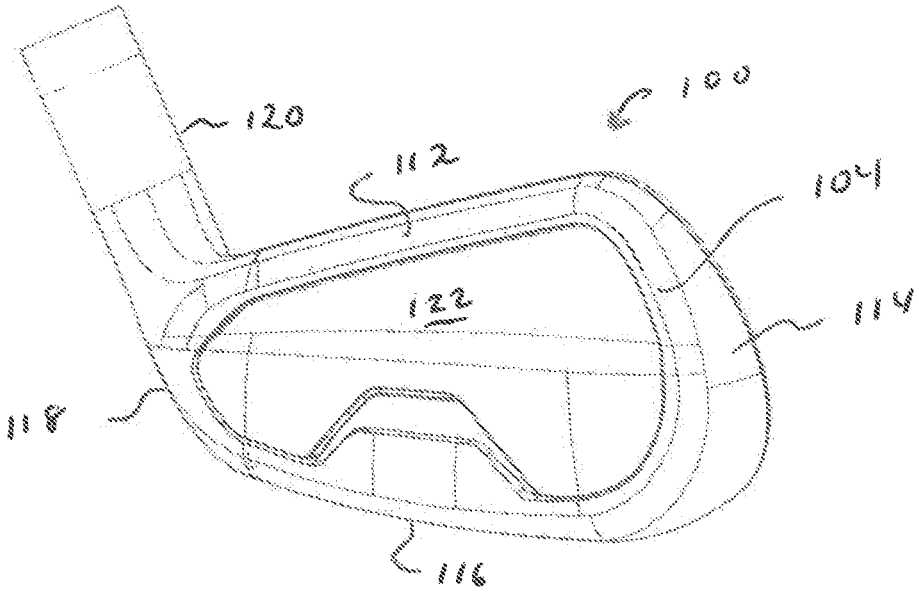
FIG. 2 of the accompanying drawings shows a rear, perspective view of the golf club disclosed in FIG. 1.

FIGS. 1-2 of the accompanying drawings shows a golf club head 100 in accordance with an exemplary embodiment of the present invention. Golf club head 100 shown here includes a striking face portion 102 and an aft body portion or body portion 104, including a topline portion 112, a toe portion 114, a sole portion 116, a heel portion 118 and a hosel 120. The hosel 120 is configured to receive the tip end of a golf shaft, not shown. The butt end of the golf shaft is configured for receiving a golf grip, also not shown. The golf club head 100 shown here has an optional back plate 122 such that the golf club head 100 is hollow.

The striking face portion 102 shown in FIG. 1 includes a substantially-planar, external frontal face portion 124, including a face center FC, and a return portion 126 that forms the leading edge LE and a front portion of the sole portion 116. The striking face portion 102 preferably has thickness at the face center of less than 2 mm and an overall mass of greater than 54 grams.

Figure 3:
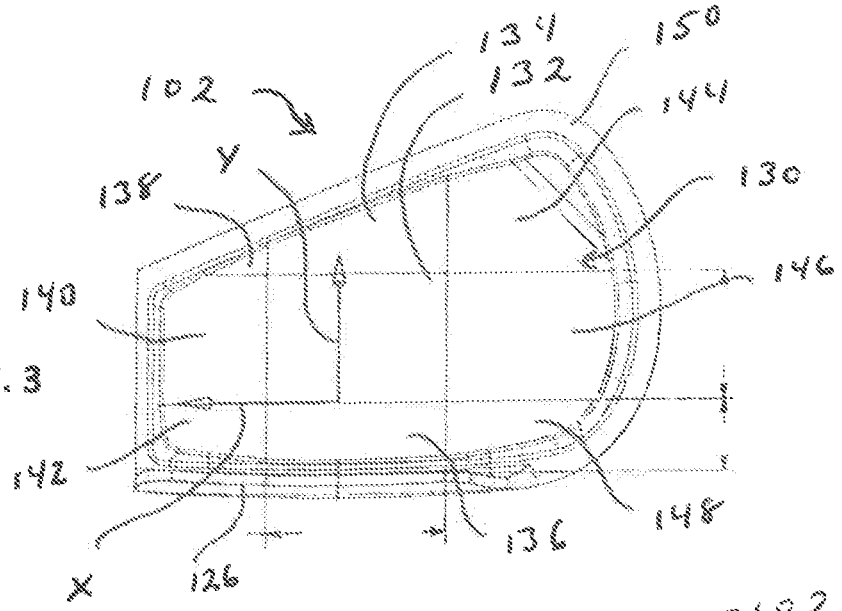
FIG. 3 of the accompanying drawings shows a back view of a club head striking face in accordance with an embodiment of the present invention.

As shown in FIG. 3, the striking face portion 102 preferably has a non-planar back face surface 130 such that the striking face portion 102 has nine zones, including a center zone 132, an upper center zone 134, a lower center zone 136, a heel upper zone 138, a heel center zone 140, a heel lower zone 142, a toe upper zone 144, a toe center zone 146 and a toe lower zone 148. The striking face portion 102 also includes an outer perimeter 150 that is welded to the topline portion 112, toe portion 114 and heel portion 118. The return portion 126 of the striking face portion 102 is also welded to the sole portion 116 to form the front portion thereof and the leading edge LE. FIG. 3 also discloses the vertical direction y and the horizontal direction x for reference.

The center zone 132 includes the face center FC and preferably has a minimum thickness t1 of the striking face. Preferably, the center zone 132 has a substantially uniform thickness t1 and has a center zone area A1 that is between about 15% and 35% of the striking face portion area, the planar area shown inside the periphery of the striking face portion 102 in FIGS. 3 and 4. Preferably, the center zone area A1 is the largest area of all nine zones. The upper center zone 134 preferably has a variable thickness that increases from a minimum thickness t1 adjacent to the center zone 132 to a maximum thickness t2 adjacent the topline portion 112. The lower center zone 136 preferably has a variable thickness that increases from minimum thickness t1 adjacent to the center zone 132 to a maximum thickness t3 adjacent the sole portion 116. The heel center zone preferably has a variable thickness that increases from minimum thickness t1 adjacent to the center zone 132 to a maximum thickness t4 adjacent the heel portion 118. The heel lower zone preferably has a variable thickness that increases from minimum thickness t1 at a point adjacent to the center zone 132 and heel center zone 140 to a maximum thickness t6 adjacent the sole portion 116. The toe center zone 146 preferably has a variable thickness that increases from minimum thickness t1 adjacent to the center zone 132 to a maximum thickness t7 adjacent the toe portion 114. Preferably, the toe upper zone maximum thickness t8 is the greatest thickness on the striking face portion 102. The toe upper zone 144 preferably has a variable thickness that increases from minimum thickness t1 at a point adjacent to the center zone 132 and toe center zone 146 to a maximum thickness t8 approximate the topline portion 112 and the toe lower zone 148 has a variable thickness that increases from minimum thickness t1 at a point adjacent to the center zone 132 and toe center zone 146 to a maximum thickness t9 adjacent the sole portion 116.

Preferably, as shown in FIGS. 4-10, the upper center zone 134 preferably has a variable thickness that continuously increases from minimum thickness t1 to the maximum thickness t2. More preferably, the upper center zone 134 preferably has a variable thickness that continuously increases on a linear slope from minimum thickness t1 to the maximum thickness t2, where the angle $\alpha$ is between 3° and 5°. The lower center zone 136 preferably has a variable thickness that continuously increases from minimum thickness t1 to the maximum thickness t3. More preferably, the lower center zone 136 has a variable thickness that continuously increases on a linear slope from minimum thickness t1 to the maximum thickness t3, where the angle $\alpha$2 is between 3° and 5°. The heel center zone preferably has a variable thickness that continuously increases from minimum thickness t1 to the maximum thickness t4. More preferably, the heel center zone 140 has a variable thickness that continuously increases on a linear slope from minimum thickness t1 to the maximum thickness t4, where the angle $\alpha$3 is between 3° and 5°. The toe center zone 146 preferably has a variable thickness that continuously increases from minimum thickness t1 adjacent to the center zone 132 to a maximum thickness t7, where the angle $\alpha$4 is between about 3° and 7° and is greater than $\alpha$3. The toe upper zone 144 preferably has a variable thickness that increases in the vertical direction, towards the topline portion 112 at an angle $\alpha$6 that is between about 1° and 4° and the toe lower zone 148 has a variable thickness that increases horizontally toward the toe portion 114 at an angle $\alpha$5 that is between about 1° and 4°.

Preferably, the center zone 132 circumscribes the face center FC projection to allow the face center FC of the external frontal face portion 124 to deflect at impact to improve the overall striking face COR. In a preferred embodiment, the thickness t1 is between about 1.5 mm and 2.0 mm, t2 is between 2.2 mm and 2.9 mm, t3 is between 2.0 mm and 2.5 mm, t4 is between 2.3 mm and 3.0 mm, t5 is between 2.1 mm and 2.5 mm, t6 is between 2.7 mm and 3.2 mm, t7 is between 3.0 mm and 3.5 mm, t8 is between 3.0 mm and 3.6 mm and t9 is between 2.8 mm and 3.2 mm. Preferably, t8>t7>t9>t6>t4>t5>t2>t3>t1. Moreover, t8 is preferably at least 50% greater than t1, t7 is at least 40% greater than t1, t2 is at least 25% greater than t1 and t3 is at least 10% greater than t1. Similarly, t1 is less than 60% t8, less than 65% of t7, and less than 80% t4.

The external frontal face portion 124 is preferably formed of steel and located at an external frontal portion of the striking face portion 102. The external frontal face portion 124 is a substantially-planar, outer surface that includes a plurality of grooves 128. More preferably, the external frontal face portion 124 is formed of a high strength steel having an Ultimate Tensile Strength of greater than 2000 MPa and more preferably greater than 2300 MPa. Most preferably, the external frontal face portion 124 is formed from AerMet 340 or the like. This thin, external frontal face portion 124 and its high strength assist in creating the high COR of the golf club head 100.

Figure 4:
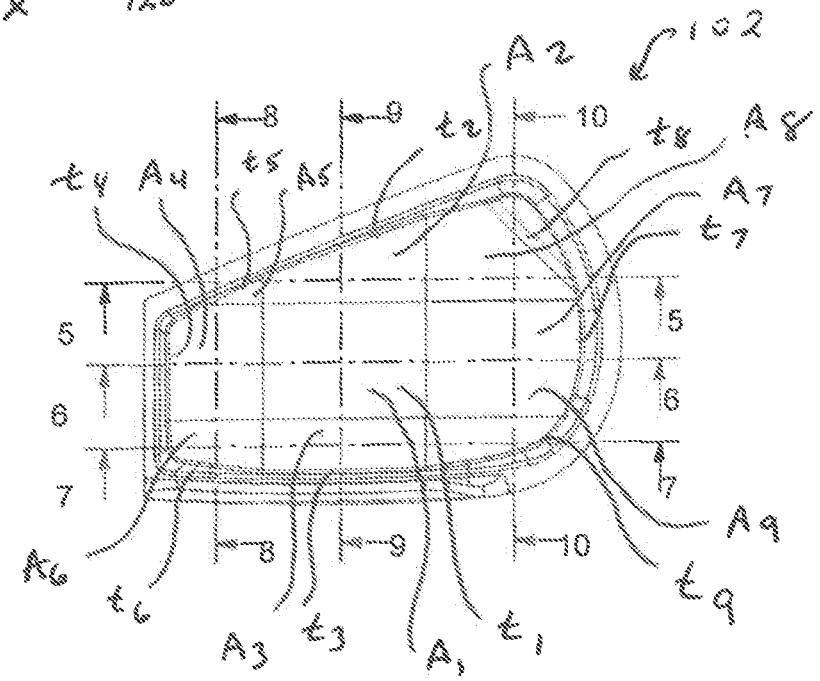
FIG. 4 of the accompanying drawings shows a back view of the striking face in FIG. 3 indicating cross-sectional views of the striking face.
Figure 5:
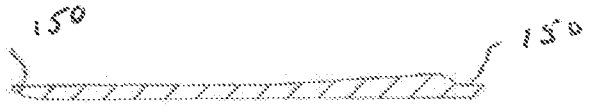
FIG. 5 of the accompanying drawings shows a horizontal cross-sectional view of the upper portion of the striking face in FIG. 3.
Figure 6:
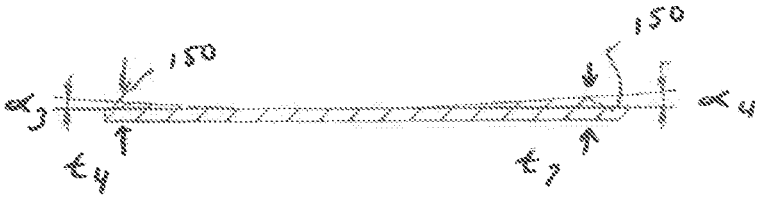
FIG. 6 of the accompanying drawings shows a horizontal cross-sectional view of the horizontal central portion of the striking face in FIG. 3.
Figure 7:
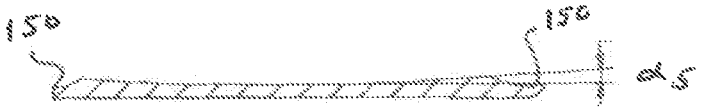
FIG. 7 of the accompanying drawings shows a horizontal cross-sectional view of the lower portion of the striking face in FIG. 3.
Figure 8:
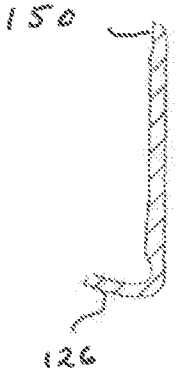
FIG. 8 of the accompanying drawings shows a vertical cross-sectional view of the heel portion of the striking face in FIG. 3.
Figure 9:
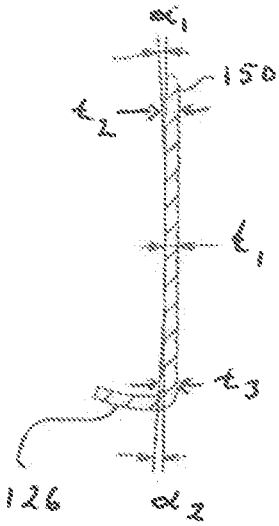
FIG. 9 of the accompanying drawings shows a vertical cross-sectional view of the vertical central portion of the striking face in FIG. 3.
Figure 10:
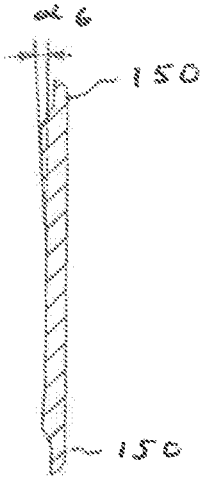
FIG. 10 of the accompanying drawings shows a vertical cross-sectional view of the toe portion of the striking face in FIG. 3.

In a preferred high COR embodiment of the present invention, the center zone has a center zone area A1 that is between about 15% and 35% of the striking face area, i.e., the planar area shown inside the periphery of the striking face portion 102 in FIGS. 3 and 4. Preferably, the center zone area A1 that is greater than the toe upper zone area A8 and the toe upper area A8 is between about 10% to 30% of the striking face area. Moreover, the center zone area A1 that is greater than the toe center zone area A7 and the toe center area A7 is between about 10% to 30% of the striking face area. Preferably, the center zone area A1 is the largest area, the upper center zone area A2 and the lower center zone area A3 are between 5% and 15% of the striking face area and the heel center zone area A4 is between 10% and 20% of the striking face area. Moreover, the area of the horizontal central portion of the face (A1+A7+A4) is greater than the area of the horizontal upper portion of the face (A2+A8+A5) plus the area of the horizontal lower portion of the face (A3+A6+A9) combined. That is the following equation is satisfied:

$$(A1 + A7 + A4) > (A2 + A8 + A5) + (A3 + A6 + A9). \quad a$$

Preferably, the area of the horizontal central portion of the face (A1+A7+A4) is greater than 50% of the striking face area.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims. For example, the example of the invention described above refers to a substantially quadrilateral-shaped center zone 132, but it is clear that the shape of the center zone 132 can be modified to a different polygonal-shape zone or elliptical-shaped zone and still meet many of the objectives of the present invention.

What is claimed is:

1. An iron type golf club comprising:

a golf club head, a grip and a shaft therebetween, wherein the golf club head is comprised of a striking face portion located at a frontal portion of the golf club head and a body portion comprising a hosel for receiving the shaft, a topline extending across an upper portion of the golf club head, a toe portion, a heel portion and a sole portion at a bottom portion of the golf club head;

the striking face portion has a striking face area and comprises nine zones, including a center zone that surrounds a face center of the striking face portion, an upper center zone located between the center zone and the topline, a lower center zone located between the center zone and the sole portion, a heel center zone located between the center zone and the heel portion, a heel upper zone located between the heel center zone and the topline, a heel lower zone located between the heel center zone and the sole portion, a toe center zone located between the center zone and the toe portion, a toe upper zone located between the toe center zone and the topline, and a toe lower zone located between the toe center zone and the sole portion:

wherein the center zone has a substantially uniform center zone thickness t1 and has a center zone area A1 that is between about 15% and 35% of the striking face area;

wherein the upper center zone has a variable thickness that increases from minimum thickness t1 adjacent to a center zone to a maximum thickness t2 adjacent the topline and has a upper center zone area A2;

wherein the lower center zone has a variable thickness that increases from minimum thickness t1 adjacent to the center zone to a lower center zone maximum thickness t3 adjacent the sole portion and has a lower center zone area A3;

wherein the heel center zone has a variable thickness that increases from minimum thickness t1 adjacent to the center zone to a heel center zone maximum thickness t4 adjacent the heel portion and has a heel center zone area A4;

wherein the heel upper zone has a variable thickness that increases from minimum thickness t1 at a point adjacent to the center zone and heel center zone to a heel upper zone maximum thickness t5 adjacent the topline and has a heel upper zone area A5;

wherein the heel lower zone has a variable thickness that increases from minimum thickness t1 at a point adjacent to the center zone and heel center zone to a heel lower zone maximum thickness t6 adjacent the sole portion and has a heel lower zone area A6;

wherein the toe center zone has a variable thickness that increases from minimum thickness t1 adjacent to the center zone to a toe center zone maximum thickness t7 adjacent the toe portion and has a toe center zone area AZ;

wherein the toe upper zone has a variable thickness that increases from minimum thickness t1 at a point adjacent to the center zone and toe center zone to a toe upper zone maximum thickness t8 adjacent the topline and has a toe upper zone area A8; and wherein the toe lower zone has a variable thickness that increases from minimum thickness t1 at a point adjacent to the center zone and toe center zone to a toe lower zone maximum thickness t9 adjacent the sole portion and has a toe lower zone area A9; and wherein the following equation is satisfied:

$$(A1 + A7 + A4) > (A2 + A8 + A5) + (A3 + A6 + A9).$$

2. The golf club of claim 1, wherein the center zone thickness t1 is less than 2.2 mm.

3. The golf club of claim 1, wherein the center zone thickness t1 is between about 1.5 mm and 2.0 mm and the center zone has a substantially quadrilateral perimeter and the center zone area A1 is greater than the toe upper zone area A8.

4. The golf club of claim 3, wherein the center zone has a substantially rectangular perimeter.

5. The golf club of claim 1, wherein the thickness across the lower center zone continuously increases from t1 to t3 and t3 is at least 10% greater than t1.

6. The golf club of claim 1, wherein the thickness across the heel center zone continuously increases from t1 to t4.

7. The golf club of claim 1, wherein the thickness across the upper heel zone continuously increases from t1 to t5.

8. The golf club of claim 1, wherein the thickness across the lower heel zone continuously increases from t1 to t6.

9. The golf club of claim 1, wherein the thickness across the center toe zone continuously increases from t1 to t7.

10. The golf club of claim 1, wherein the thickness across the upper toe zone continuously increases from t1 to t8.

11. The golf club of claim 1, wherein the thickness across the lower toe zone continuously increases from t1 to t9.

12. The golf club of claim 1, wherein the center zone thickness t1 is between about 1.5 mm and 2.0 mm and the center zone has a substantially quadrilateral perimeter and the center zone area A1 is greater than the toe center zone area A7.

13. An iron type golf club comprising:

a golf club head, a grip and a shaft therebetween, wherein the golf club head is comprised of a striking face portion located at a frontal portion of the golf club head and a body portion comprising a hosel for receiving the shaft, a topline extending across an upper portion of the golf club head, a toe portion, a heel portion and a sole portion at a bottom portion of the golf club head;

the striking face portion has a striking face area and comprises nine zones, including a center zone that surrounds a face center of the striking face portion, an upper center zone located between the center zone and the topline, a lower center zone located between the center zone and the sole portion, a heel center zone located between the center zone and the heel portion, a heel upper zone located between the heel center zone and the topline, a heel lower zone located between the heel center zone and the sole portion, a toe center zone located between the center zone and the toe portion, a toe upper zone located between the toe center zone and the topline, and a toe lower zone located between the toe center zone and the sole portion:

wherein the center zone has a substantially uniform center zone thickness t1 and has a center zone area A1 that is between about 15% and 35% of the striking face area;

wherein the upper center zone has a variable thickness that increases from minimum thickness t1 adjacent to a center zone to a maximum thickness t2 adjacent the topline and has a upper center zone area A2;

wherein the lower center zone has a variable thickness that increases from minimum thickness t1 adjacent to the center zone to a lower center zone maximum thickness t3 adjacent the sole portion and has a lower center zone area A3;

wherein the heel center zone has a variable thickness that increases from minimum thickness t1 adjacent to the center zone to a heel center zone maximum thickness t4 adjacent the heel portion and has a heel center zone area A4;

wherein the heel upper zone has a variable thickness that increases from minimum thickness t1 at a point adjacent to the center zone and heel center zone to a heel upper zone maximum thickness t5 adjacent the topline and has a heel upper zone area A5;

wherein the heel lower zone has a variable thickness that increases from minimum thickness t1 at a point adjacent to the center zone and heel center zone to a heel lower zone maximum thickness t6 adjacent the sole portion and has a heel lower zone area A6;

wherein the toe center zone has a variable thickness that increases from minimum thickness t1 adjacent to the center zone to a toe center zone maximum thickness t7 adjacent the toe portion and has a toe center zone area A7;

wherein the toe upper zone has a variable thickness that increases from minimum thickness t1 at a point adjacent to the center zone and toe center zone to a toe upper zone maximum thickness t8 adjacent the topline and has a toe upper zone area A8;

wherein the toe lower zone has a variable thickness that increases from minimum thickness t1 at a point adjacent to the center zone and toe center zone to a toe lower zone maximum thickness t9 adjacent the sole portion and has a toe lower zone area A9; and wherein the upper center zone maximum thickness t2 is less than the heel center zone maximum thickness t4 and the toe center zone maximum thickness t7.

14. The golf club of claim 13, wherein the center zone thickness t1 is less than 65% of the heel center zone maximum thickness t7.

15. The golf club of claim 13, wherein the center zone thickness t1 is less than 80% of the heel center zone maximum thickness t4.

16. An iron type golf club comprising:

a golf club head, a grip and a shaft therebetween, wherein the golf club head is comprised of a striking face portion located at a frontal portion of the golf club head and a body portion comprising a hosel for receiving the shaft, a topline extending across an upper portion of the golf club head, a toe portion, a heel portion and a sole portion at a bottom portion of the golf club head;

the striking face portion has a striking face area and comprises nine zones, including a center zone that surrounds a face center of the striking face portion, an upper center zone located between the center zone and the topline, a lower center zone located between the center zone and the sole portion, a heel center zone located between the center zone and the heel portion, a heel upper zone located between the heel center zone and the topline, a heel lower zone located between the heel center zone and the sole portion, a toe center zone located between the center zone and the toe portion, a toe upper zone located between the toe center zone and the topline, and a toe lower zone located between the toe center zone and the sole portion:

wherein the center zone has a substantially uniform center zone thickness t1 and has a center zone area A1 that is between about 15% and 35% of the striking face area;

wherein the upper center zone has a variable thickness that increases from minimum thickness t1 adjacent to a center zone to a maximum thickness t2 adjacent the topline;

wherein the lower center zone has a variable thickness that increases from minimum thickness t1 adjacent to the center zone to a lower center zone maximum thickness t3 adjacent the sole portion;

wherein the heel center zone has a variable thickness that increases from minimum thickness t1 adjacent to the center zone to a heel center zone maximum thickness t4 adjacent the heel portion;

wherein the heel lower zone has a variable thickness that increases from minimum thickness t1 at a point adjacent to the center zone and heel center zone to a heel lower zone maximum thickness t6 adjacent the sole portion;

wherein the toe center zone has a variable thickness that increases from minimum thickness t1 adjacent to the center zone to a toe center zone maximum thickness t7 adjacent the toe portion;

wherein the toe upper zone has a variable thickness that increases from minimum thickness t1 at a point adjacent to the center zone and toe center zone to a toe upper zone maximum thickness t8 adjacent the topline;

wherein the toe lower zone has a variable thickness that increases from minimum thickness t1 at a point adjacent to the center zone and toe center zone to a toe lower zone maximum thickness t9 adjacent the sole portion; and wherein the toe upper zone has a toe upper area A8 that is between about 10% to 30% of the striking face area.

17. The golf club of claim 16, wherein the toe center zone has a toe center area A7 that is between about 10% to 30% of the striking face area.

18. An iron type golf club comprising:

a club head, a grip and a shaft therebetween, wherein the golf club head is comprised of a striking face portion located at a frontal portion of the club head and a body portion comprising a hosel for receiving the shaft, a topline extending across an upper portion of the club head, a toe portion, a heel portion and a sole portion at a bottom portion of the club head;

the striking face portion has a striking face area and comprises nine zones, including a center zone that surrounds a face center of the striking face portion, an upper center zone located between the center zone and the topline, a lower center zone located between the center zone and the sole, a heel center zone located between the center zone and the heel portion, a heel upper zone located between the heel center zone and the topline, a heel lower zone located between the heel center zone and the sole, a toe center zone located between the center zone and the toe portion, a toe upper zone located between the toe center zone and the topline, and a toe lower zone located between the toe center zone and the sole;

wherein the center zone has a substantially uniform thickness t1 and has a center zone area A1 that is between about 15% and 30% of the striking face area;

wherein the upper center zone has a variable thickness that increases from minimum thickness t1 adjacent to the center zone to a upper center zone maximum thickness t2 adjacent the topline and has an upper center zone area A2 that is between 5% and 15% of the striking face area, the upper center zone maximum thickness t2 is at least 25% greater than the center zone thickness t1;

wherein the lower center zone has a variable thickness that increases from minimum thickness t1 adjacent to the center zone to a lower center zone maximum thickness t3 adjacent the sole;

wherein the heel center zone has a variable thickness that increases from minimum thickness t1 adjacent to the center zone to a heel center zone maximum thickness t4 adjacent the heel portion; and wherein the toe center zone has a variable thickness that increases from the minimum thickness t1 adjacent to the center zone to a toe center zone maximum thickness t7 adjacent the toe portion and has a toe center zone area that is between 10% and 30% of the striking face area, the center zone minimum thickness t1 is less than 65% of the toe center zone maximum thickness t7.

19. The golf club of claim 18, wherein the center zone thickness t1 is less than 2 mm and the striking face portion has a mass of greater than 54 grams.

* * * * *